US008489404B2

(12) United States Patent
Lin et al.

(10) Patent No.: US 8,489,404 B2
(45) Date of Patent: Jul. 16, 2013

(54) METHOD FOR DETECTING AUDIO SIGNAL TRANSIENT AND TIME-SCALE MODIFICATION BASED ON SAME

(75) Inventors: Zhongsong Lin, Shanghai (CN); Shidong Shang, Shanghai (CN); Shengjiu Wang, Shanghai (CN)

(73) Assignee: Freescale Semiconductor, Inc., Austin, TX (US)

( * ) Notice: Subject to any disclaimer, the term of this patent is extended or adjusted under 35 U.S.C. 154(b) by 170 days.

(21) Appl. No.: 13/047,800

(22) Filed: Mar. 15, 2011

(65) Prior Publication Data

US 2011/0246205 A1 Oct. 6, 2011

(30) Foreign Application Priority Data

Apr. 2, 2010 (CN) ..... 2010 1 01139991

(51) Int. Cl.
*G10L 19/00* (2006.01)

(52) U.S. Cl.
USPC ..... 704/500; 704/203; 704/211; 704/213; 704/503

(58) Field of Classification Search
USPC ..... 704/200–230, 500–503
See application file for complete search history.

(56) References Cited

U.S. PATENT DOCUMENTS 5,976,081 A * 11/1999 Silverman ..... 600/300
6,049,766 A * 4/2000 Laroche ..... 704/216
6,597,961 B1 * 7/2003 Cooke ..... 700/94
6,766,300 B1 * 7/2004 Laroche ..... 704/500
6,826,525 B2 * 11/2004 Hilpert et al. ..... 704/200.1
6,940,967 B2 * 9/2005 Makinen et al. ..... 379/387.01
7,424,026 B2 9/2008 Mallila

FOREIGN PATENT DOCUMENTS

WO WO 2009/029033 * 3/2009

OTHER PUBLICATIONS

J. Laroche and M. Dolson, "Improved phase vocoder time-scale modification of audio," IEEE Trans. Speech Audio Process., vol. 7, No. 3, pp. 323-332, May 1999.*

Groft, S.; Lavner, Y.;, "Time-Scale Modification of Audio Signals Using Enhanced WSOLA With Management of Transients," Audio, Speech, and Language Processing, IEEE Transactions on , vol. 16, No. 1, pp. 106-115, Jan. 2008 doi: 10.1109/TASL.2007.909444 URL: http://ieeexplore.ieee.org/stamp/stamp.jsp?tp=&arnumber=4381234&isnumber=4407525.*

S. Lee, H. D. Kim, and H. S. Kim, "Variable time-scale modification of speech using transient information, " in Proc. IEEE Int. Conf. Acoust., Speech, Signal Process. (ICASSP), Munich, Germany, 1997, pp. 1319-1322.*

W. Verhelst and M. Roelands, "An overlap-add technique based on waveform similarity (WSOLA) for high quality time-scale modification of speech," in Proc. ICASSP. Apr. 1993, pp. 554-557.*

(Continued)

*Primary Examiner* — Douglas Godbold
*Assistant Examiner* — Ernest Estes
(74) *Attorney, Agent, or Firm* — Charles Bergere

(57) ABSTRACT

A method for detecting a transient in an audio signal that has been broken up into frames includes obtaining a time domain feature of the frames and comparing the domain feature with a predetermined value. If the time domain feature is greater than the predetermined value, the frames are taken as transient and if the time domain feature is less than the predetermined value, the frames are taken as non-transient. The method has a low computational intensity and is thus very suitable for devices with limited processing resources.

5 Claims, 3 Drawing Sheets

OTHER PUBLICATIONS

Shahaf Grofit and Yizhar Lavner, "Time-Scale Modification of Audio Signals Using Enhanced WSOLA With Management of Transients", IEEE Transactions on Audio, Speech and Language Processing, vol. 16, No. 1, Jan. 2008, pp. 106-1115.

Werner Verhelst and Marc Roelands, "An Overlap-Add Technique Based on Waveform Similarity (WSOLA) for High Quality Time-Scale Modification of Speech", IEEE International Conference on Acoustics, Speech and Signal Processing 1993, ICASSP-93, vol. 2, 1993, pp. II-554 to II-557.

J.J. Mariani and J.S. Lienard, "Acoustic-Phonetic Recognition of Connected Speech Using Transient Information", Acoustics, Speech and Signal Processing, IEEE International Conference on ICASSP 1977, May 1977, pp. 667-670.

Sungjoo Lee et al., "Variable Time-Scale Modification of Speech Using Transient Information", IEEE International Conference on Acoustics, Speech and Signal Processing, 1997, ICASSP-97, Apr. 1997, pp. 1318-1321.

Mylene D. Kwong and Roch Lefebvre, "Transient Detection of Audio Signals Based on an Adaptive Comb Filter in the Frequency Domain", 2003 IEEE International Conference on Signal Processing and Communications, ICSPC 2003, Nov. 2003, pp. 542-545.

* cited by examiner

METHOD FOR DETECTING AUDIO SIGNAL TRANSIENT AND TIME-SCALE MODIFICATION BASED ON SAME

BACKGROUND OF THE INVENTION

The present invention relates generally to digital signal processing and, more specifically, to detection of transients in audio signals.

Time-Scale Modification (TSM) of audio signals is the process of modifying the duration of a signal while maintaining other qualities such as the pitch and the timbre. The purpose of time-scaling is to change the rate at which acoustic events are experienced, while retaining their perceived naturalness.

Various algorithms have been proposed for high-quality TSM of audio signals. Algorithms for TSM of audio signals on time-domain synchronized overlap-and-add (SOLA), such as the waveform similarity overlap-and-add (WSOLA), have been shown to achieve very good results at a low computational cost, and thus are suitable for real-time synthesis systems. Examples of WSOLA algorithms are specified in "An Overlap-Add Technique Based on Waveform Similarity (WSOLA) for High Quality Time-Scale Modification of Speech" by W. Verhelst and M. Roelands (IEEE 1993).

However, when TSM is performed, transients, such as attacks and decays can either be smeared or removed, introducing artifacts, which cause perceptual quality to degrade. An improvement may be achieved by keeping the transient sections without modifications. For this purpose, accurate detection of the transients is required.

Transients are short duration audio signals, and are often in form of high frequency noise or an energy attack. FIG. 1 is a waveform diagram illustrating the sound of the word "too" when spoken. The unvoiced part of 't' is taken as transient. FIG. 2 is a waveform diagram illustrating an energy attack in instrumental music. The energy attack is identified by the spike in the signal.

Combined with the well-known WSOLA algorithm, a method for transient detection to achieve better sound quality is disclosed in "Time-Scale Modification of Audio Signals Using Enhanced WSOLA with Management of Transients", by Shahaf Grofit (IEEE 2008). In this publication, methods for locating and selecting transients are provided.

The first method uses a distance function based on the Mel Frequency Cepstrum Coefficients (MFCCs). The Mel Cepstrum is one of the most common spectral representations of audio signals. It is based on characteristics of the human auditory system, such as the nonlinear frequency perception and the existence of critical bands. The MFCCs are known to be very efficient in various speech and speaker recognition algorithms. The second method uses the normalized correlation data, which is computed as part of the OLA (Overlap-Add) process. The normalized cross-correlation can be used as an additional measure for detection of transients.

Such methods are computationally complex and are not suitable for portable devices. Accordingly, there is a need for an improved method for detecting transients in audio signals.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

A detailed description of one or more preferred embodiments of the invention is provided below along with accompanying figures that illustrate by way of example the principles of the invention. While the invention is described in connection with such embodiments, it should be understood that the invention is not limited to any one embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention provides a method for detecting transients using a measure based on time domain features of audio signals, with a time-variant threshold. The method has low computational intensity and thus is suitable for use on devices with limited computational abilities such as cell phones, portable digital recorders and the like.

In one embodiment, the present invention provides a method for detecting transients in an audio signal, where the audio signal is separated into a plurality of frames for processing. The method includes obtaining time domain features of the frames and comparing the time domain features with predetermined values. If a time domain feature is larger than a predetermined value, the frames are considered transient. If the time domain feature is less than the predetermined value, the frames are considered non-transient.

In another embodiment, the present invention provides a method for time-scale modification of an audio signal with transient detection. The audio signal is separated into a plurality of frames to be processed and then transient frames are detected, as described above. The plurality of frames are then processed, where non-transient frames are time scaled using one of a phase vocoder and WSOLA, and transient frames are not time scaled. The non-time scaled frames may be output directly.

In some embodiments, detection of transients based on time features is performed using a combination of two criteria, namely energy and a zero-cross rate (ZCR) of a frame.

The energy within a frame is the output signal intensity of the frame, which may be readily computed. ZCR is another basic acoustic feature that may be readily computed. In general, ZCR of unvoiced sounds is greater than that for voiced sounds, which have observable fundamental periods, making ZCR an important indication of voiced and unvoiced sounds. Further, ZCR reflects the frequency domain feature of an audio signal.

A large change in either ZCR or energy can be regarded as a good indication of the presence of a transient. Unvoiced human speech usually has low energy and high ZCR, while attacks in music may have low ZCR and high energy. The present invention is directed to audio signal (both speech and music) processing.

Figure 1:
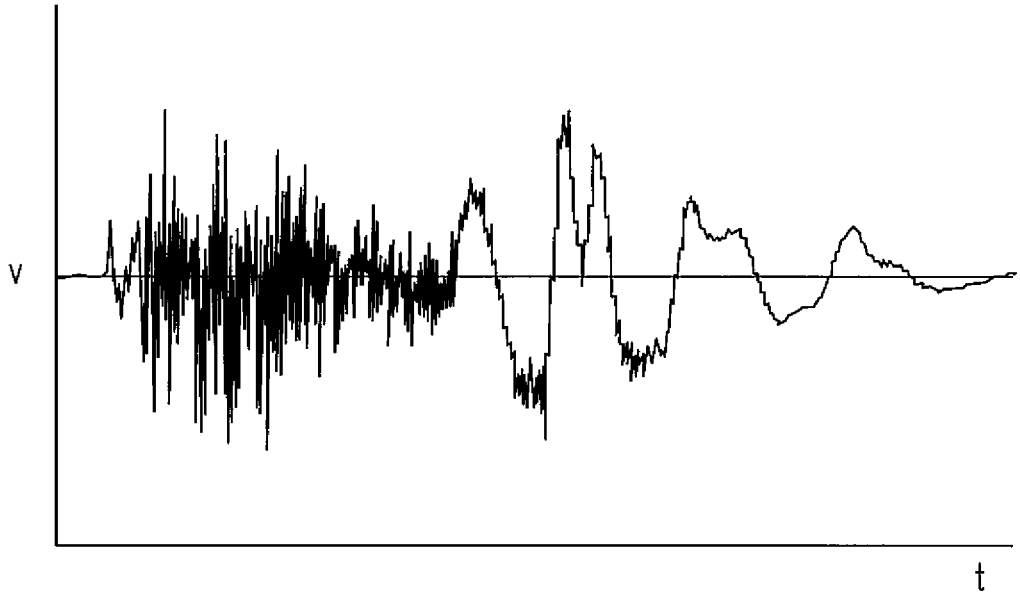
FIG. 1 is a wave form diagram of an audio signal of the speech of the word "too", in which the unvoiced part of "t" is taken as transient.
Figure 2:
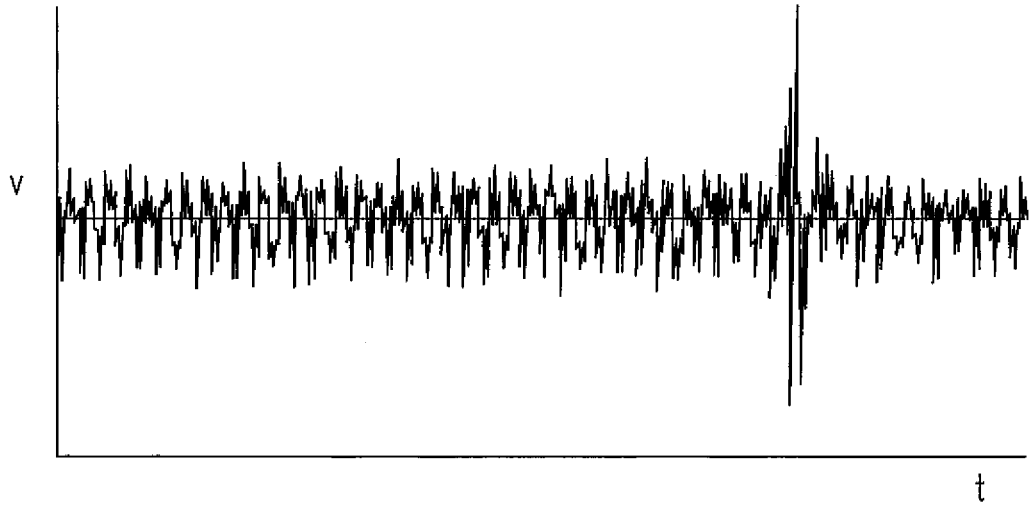
FIG. 2 is a wave form diagram of an audio signal illustrating an energy attack in instrumental music.
Figure 3:
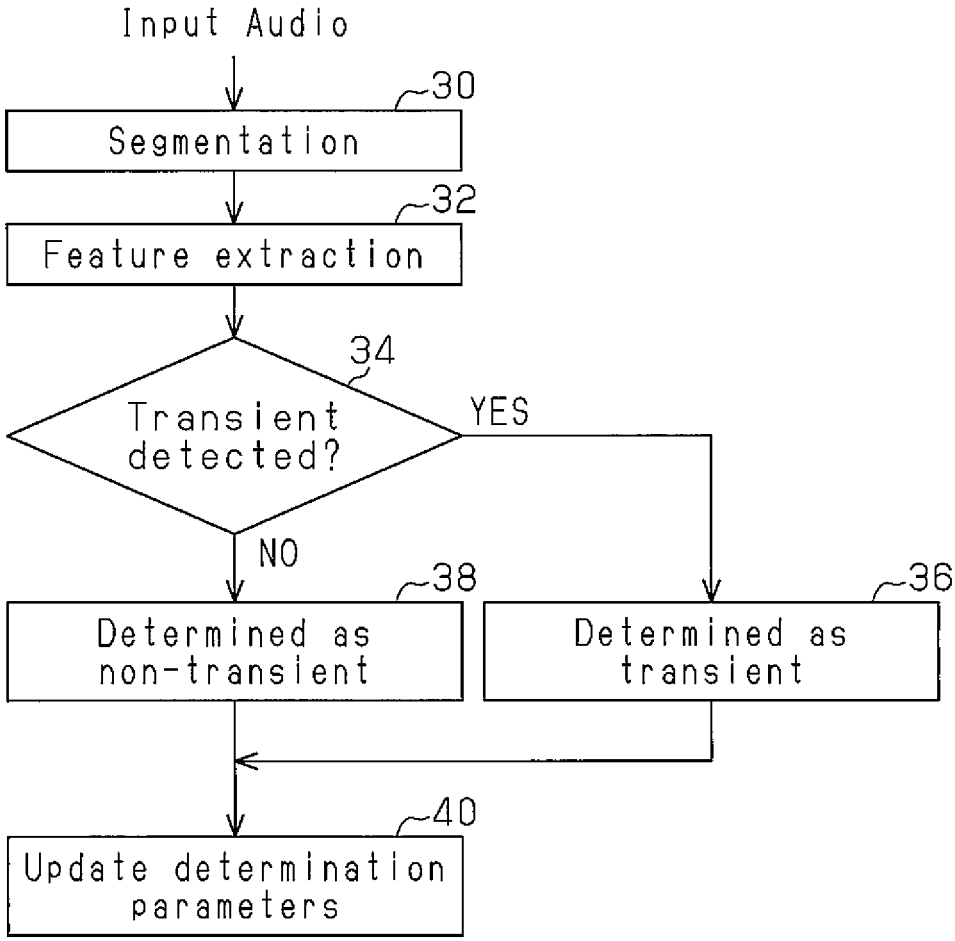
FIG. 3 is a flowchart illustrating transient detection in accordance with an embodiment of the present invention.

Referring now to FIG. 3, a method for transient detection according to a first embodiment of the present invention will be described. At a first step 30, an input audio signal is segmented into frames. In processing audio signals, a method of short-term analysis is employed since most audio signals are more or less stable within a short period of time, for example 20 mS or so per frame. If the frame duration is too long, it is difficult to catch the time-varying characteristics of the audio signal. On the other hand, if the frame duration is too short, then it is difficult to extract valid acoustic features. In general, a frame should contain several fundamental periods of the input audio signal. In one embodiment of the invention, the audio signal to be processed (input audio signal) is segmented into 20 mS frames, which is common for audio processing.

Transients are often very fast, for example, unvoiced parts in human speech last less then 20 mS, and closer to about 4-5 mS. Therefore, it is desirable to divide an input frame into several equal length, sequential segments for transient detection. Thus, in one embodiment, the frames are further segmented into four equal length segments.

At step 32, time domain features of the frames are extracted. In one embodiment, the time domain features comprise the energy and the zero-cross rate (ZCR). The steps for time domain feature extraction are as follows.

The energy of each segment of an input frame is calculated and also, a zero-cross count of the input frame is calculated. The zero-cross count is the number of occurrences of a segment that have a different sign bit from a previous sample in the current segment. Thus, the energy and ZCR of each segment in the input frame are obtained.

Next, at step 34, transient detection is performed using the above-described extracted features of each segment, and steps 36 and 38 illustrate the alternative results of step 34, i.e., a segment (or frame) being determined as transient (step 36) and a segment (or frame) being determined as non-transient. More specifically, a segment of the input frame is considered to be a transient if at least one of the following is true. Segments with a predetermined amount of energy as compared to a previous segment are determined to be transients. That is, a segment whose energy difference with the previous segment is equal to or greater than a predetermined energy difference value is taken as transient.

Segments with too large a ZCR are taken as transients too. More specifically, a segment whose ZCR is equal to or greater than a predetermined ZCR value is taken as transient. In one embodiment, the predetermined ZCR value is the average ZCR of the input audio signal. At step 40, which in one embodiment is performed after both of steps 36 and 38, the predetermined energy difference value and the predetermined ZCR value are updated for each frame (and for each segment, as the case may be).

In one embodiment of the invention, the predetermined energy difference value and the average ZCR are only updated if the current segment is not determined to be a transient. In some embodiments, an adaptive coefficient, which is an empirical value, is used as the average zero-cross computation, which allows for accurate adjustment of the average ZCR.

Determining the threshold (i.e., the predetermined energy difference value and the average ZCR) comprises certain tradeoffs. If the selected threshold value is too low, only a few transients will be detected and other transients may be time-scaled, leading to audio degradation. On the other hand, if the threshold value is too high, a large portion of the signal will be considered to be transient and thus directly output, without scaling, causing tempo distortions. These settings are independent of sample rates and the input audio characters.

Steps 30-40 are repeated until all frames of the audio signal have been processed.

A second embodiment of a method for transient detection according to the present invention will now be discussed with reference to FIG. 4, which is a flow chart illustrating a Time-Scale Modification processing method based on WSOLA with time domain transient detection, in accordance with an embodiment of the present invention. For purposes of example, it is assumed that the input audio signal is 16 bits, mono/stereo channel. However, as will be understood by those of skill in the art, the invention will apply to other sized audio signals such as 32 bit signals.

The TSM method may be implemented in software running on a processor, a combination of software and hardware, or even with a custom circuit. In a preferred embodiment of the present invention, the method is implemented in software executed on a microprocessor. The software includes some constants, including: (1) number of segments per sample; (2) energy ratio for transient detection; (3) ZCR high threshold; (4) ZCR low threshold; (5) adaptive coefficient for average zero-cross computation; and (6) max value the absolute difference between two frames of the audio signal will not exceed.

As previously mentioned, the input audio signal is broken up into frames and the frames are broken up into segments. Preferably, the frames are of equal length (e.g., 20 mS), and the segments are of equal length (e.g., 4 mS). As discussed in more detail below, two frames of data may be used together for transient detection. That is, if a transient is detected, the frame data may be compared to some or all of the data from a previous frame for WSOLA synthesis.

Figure 4:
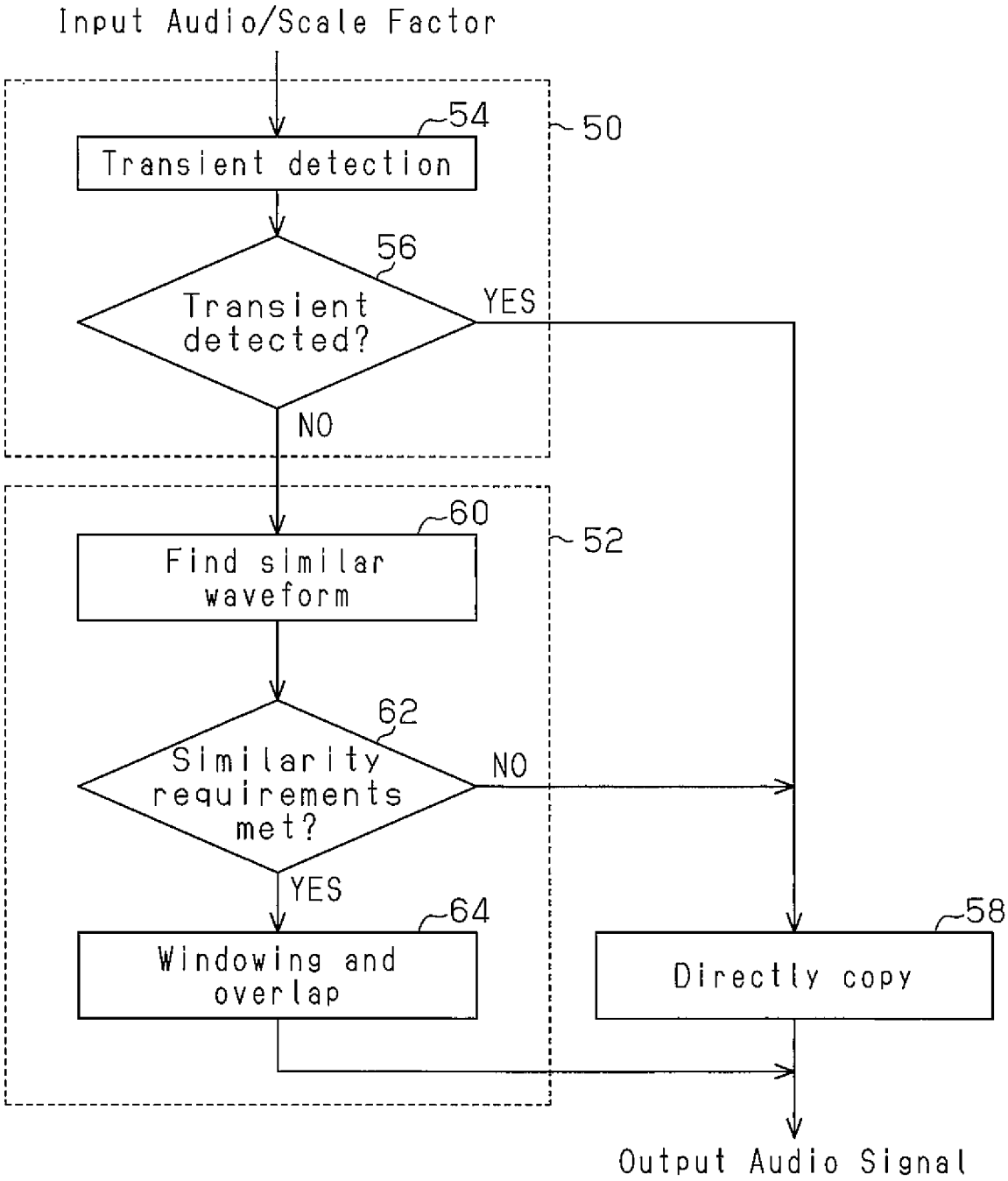
FIG. 4 is a flowchart illustrating an optimized Time-Scale Modification processing method based on WSOLA with time domain transient detection in accordance with an embodiment of the present invention.

FIG. 4 shows that the method has two basic stages, a transient detection stage 50 and a WSOLA stage 52. First, an audio signal is received and provided to the transient detection stage 50. In a first step 54, transient detection is performed, which includes receiving a frame of audio data. The received frame is separated into segments and then the audio signal is analyzed segment by segment. The current segment is considered to be a transient if the segment has too much energy as compared to the last segment or the segment has too high a ZCR.

The energy and ZCR of a segment are used to detect a transient, and the values used for energy and ZCR comparison are updated whenever a non-transient segment is detected. The transient detection step 54 calculates the frame energy of the current frame. At step 56, if the current frame energy is greater than a predetermined value, then it is determined there is a transient and the process proceeds to step 58. On the other hand, if the current frame energy does not exceed the predetermined value, then no transient has been detected and the audio signal is provided to the WSOLA stage 52.

At step 58, a transient frame is output directly as the audio signal, without modification, the frame energy (predetermined frame energy comparison value) and the average ZCR are updated, and then the process returns to step 54 to process the next frame of audio signal data. In one embodiment, the predetermined energy comparison value is calculated as a simple running average, while ZCR is calculated by counting the occurrences within the segment that have different sign values (i.e., positive values indicate above the ZCR and negative values indicate below the ZCR).

As mentioned above, if neither of the two tests indicates that a transient has been detected, then the audio signal is provided to the WSOLA stage 52, and step 60 is performed. At step 60, a similar waveform module is used to locate a similar waveform from previously process audio data. In this case, similar means a distance between similar waveforms. This process is only needed for the first channel of the input audio signal because the second channel result will be similar to the first. Step 62 determines if the similarity requirements have been met. If the audio data is similar, then at step 64, windowing and overlap is conducted. If the audio data is not similar, then the current input audio frame is output directly via step 58, which already has been described.

Referring again to step 60, the object of this process is to find the waveforms that have a maximum waveform similarity. To make the waveform similarity computation as simple as possible, in one embodiment of the invention, the absolute differences between the waveforms are calculated, and the waveform with the least absolute difference to the current wave form is selected. If the input is stereo channel, this process is only necessary for the first channel because the second channel is similar to the first channel except for the phase difference.

If the determined minimum absolute difference is larger than a predetermined value, then it is determined that the waveforms are not very similar and thus performing a windowing and overlap process (step 64) will probably degrade the sound quality of the signal so in this case, the method goes to step 58 and the frame is directly output without modification. Otherwise, at step 64, windowing and overlap is applied to the frame of audio data.

Although the steps of the process above have been defined as sequential, it will be understood by those of skill in the art that some of the steps and sub-steps may be performed in parallel with each other to reduce processing time. Further, it should be appreciated that the present invention can be implemented in numerous ways, including as a process, an apparatus, a system, or a computer-readable medium such as a computer-readable storage medium or a computer network where program instructions are sent over optical or electronic communication links. It should be noted that except as specifically noted the order of the steps of the disclosed processes may be altered within the scope of the invention. Additionally, it should be understood that the present invention may be embodied with a phase vocoder instead of with the WSOLA module 52. Transient detection with a phase vocoder is simple because the only transient detection method employed is using the energy.

A subjective listening test was conducted using a few different algorithms and results were compiled. Seven different test cases were selected for time-scale modification at various play speed rates using five different algorithms: WSOLA, WSOLA with transient detection, Phase Vocoder, Phase Vocoder with transient detection, and Windows Media Player (the output of which was recorded by a computer). The results of the test indicated that the WSOLA with transient detection provided the best results, followed by WSOLA, phase vocoder with transient detection, media player and then the phase vocoder. The test data also indicated that transient detection was less than 10% of the WSOLA computation.

The present invention has the following advantages: (1) A method for transient detection based on time domain features is provided that has very low computation intensity; (2) A 20 mS input audio frame is segmented into 5 mS segments to quickly detect transients, which often occur in fast music and human speech. Thus, high detection accuracy is provided; (3) ZCR is used to avoid stretching of high-frequency and no pitch audio segments, such as unvoiced speech; (4) the average ZCR for transient detection may include an adaptive coefficient, which is an empirical value, to accurately adjust the average ZCR; (5) the transient detection scheme employed allows for stereo channel input without effecting the phase difference between left and right channels; and (6) detected transients are not modified (e.g., not time-scaled), which improves sound quality over an algorithm that modifies all data frames.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

The invention claimed is:

1. A method for time scale modification of an audio signal, comprising:

receiving an audio signal;

separating the audio signal into a plurality of frames;

obtaining at least one time domain feature of each of the frames, including:

segmenting the frames into a plurality of sequential equal length segments; and computing an average signal energy of the segments and an average zero-cross rate (ZCR) of the segments, wherein the at least one time domain feature includes the average signal energy and the average ZCR;

analyzing a current frame of the plurality of frames to detect a transient, wherein said analyzing comprises comparing the at least one time domain feature of the current frame with a predetermined value, wherein if the time domain feature is greater than the predetermined value, the frame is determined to include a transient, wherein the predetermined value comprises the average signal energy of a previous segment and the average ZCR, wherein if an energy difference of a current segment exceeds the average signal energy of the previous segment then the current frame containing the current segment is determined as including a transient, and if the ZCR of the current segment exceeds the average ZCR, the current frame containing the current segment is determined as including a transient, and wherein the average ZCR is regulated by multiplying the average ZCR with an adaptive coefficient;

processing the plurality of frames, wherein frames that do not include a transient are time scale modified and frames that include a transient are not time scale modified; and outputting the processed frames.

2. The method for time scale modification of an audio signal of claim 1, wherein a frame has a duration of 20 mS.

3. The method for time-scale modification of an audio signal claim 1, wherein the time-scale modifying is performed according to wave form similarity overlap-and-add (WSOLA).

4. The method for time-scale modification of an audio signal of claim 1, wherein the time-scale modifying is performed by a phase vocoder.

5. The method for time scale modification of an audio signal of claim 1, wherein each segment has a length of 5 mS.

* * * * *